US009861195B2

(12) United States Patent
Lucas et al.

(10) Patent No.: US 9,861,195 B2
(45) Date of Patent: Jan. 9, 2018

(54) SETTING DEVICE FOR A LATCHING ARRANGEMENT FOR SETTING A MOVABLE FURNITURE PART WHICH IS RECEIVED ON A FURNITURE BODY

(71) Applicant: Grass GmbH, Hoechst (AT)

(72) Inventors: Tim Lucas, Leinfelden-Echterdingen (DE); Gabriel Auer, Maeder (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 15/334,708

(22) Filed: Oct. 26, 2016

(65) Prior Publication Data

US 2017/0112278 A1 Apr. 27, 2017

(30) Foreign Application Priority Data

Oct. 26, 2015 (DE) ..... 20 2015 105 679

(51) Int. Cl.

*A47B 88/00* (2017.01)
*E05B 65/44* (2006.01)
*A47B 88/04* (2006.01)

(52) U.S. Cl.

CPC ..... *A47B 88/0055* (2013.01); *A47B 88/0418* (2013.01); *E05B 65/44* (2013.01); *A47B 2088/0059* (2013.01)

(58) Field of Classification Search

CPC ..... A47B 88/0055; A47B 88/0418; A47B 2088/0059; A47B 2210/0054; A47B 2210/0056; A47B 2210/0059; A47B 2210/091; A47B 88/407; A47B 88/423; A47B 88/4235; A47B 88/427;

(Continued)

(56) References Cited

U.S. PATENT DOCUMENTS 5,375,922 A * 12/1994 Brustle ..... A47B 88/427 312/330.1
5,439,283 A 8/1995 Schröder et al.

(Continued)

FOREIGN PATENT DOCUMENTS

DE 20 2007 014 954 U1 1/2009
DE 20 2010 016 913 U1 5/2012

(Continued)

OTHER PUBLICATIONS

European Search Report, European Application No. 16193866.7, dated Feb. 23, 2017 (6 pages).

(Continued)

*Primary Examiner* — Hanh V Tran
(74) *Attorney, Agent, or Firm* — Burr & Brown, PLLC

(57) ABSTRACT

A setting device for a latching arrangement for setting a movable furniture part which is received in a furniture body, the setting device comprising a receptacle, a spring member and an operating lever, it being possible for the setting device to be mounted on a holding member of the latching arrangement such that it can be pivoted via the receptacle, and a latching element being configured on the spring member. The invention is distinguished by the fact that the shape of the spring member, and therefore the position of the latching element, can be varied by means of the operating lever, without interaction with a further element.

10 Claims, 6 Drawing Sheets

(58) Field of Classification Search
CPC ..... A47B 88/4272; A47B 88/4276; A47B 88/4278; A47B 88/43; E05B 65/44
See application file for complete search history.

(56) References Cited

U.S. PATENT DOCUMENTS

| | | | | |
|---|---|---|---|---|
| 5,588,729 | A * | 12/1996 | Berger | A47B 88/427 312/330.1 |
| 6,923,518 | B2 * | 8/2005 | Kim | A47B 88/423 312/334.4 |
| 7,014,282 | B2 * | 3/2006 | Hammerle | A47B 88/427 312/330.1 |
| 7,226,139 | B2 * | 6/2007 | Salice | A47B 88/427 312/330.1 |
| 8,220,884 | B2 * | 7/2012 | Berger | A47B 88/427 312/334.4 |
| 8,366,218 | B2 * | 2/2013 | Janzen | A47B 88/427 312/334.1 |
| 9,095,211 | B2 * | 8/2015 | Amann | A47B 88/0422 |
| 9,259,087 | B1 * | 2/2016 | Hsiao | A47B 88/0055 |
| 2004/0095047 | A1 * | 5/2004 | Salice | A47B 88/427 312/332.1 |
| 2012/0319548 | A1 * | 12/2012 | Netzer | A47B 88/0422 312/334.1 |
| 2013/0113356 | A1 * | 5/2013 | Salice | A47B 88/0422 312/334.44 |
| 2014/0055021 | A1 | 2/2014 | Grabherr et al. | |

FOREIGN PATENT DOCUMENTS

| | | |
|---|---|---|
| DE | 20 2014 102 893 U1 | 10/2015 |
| EP | 0 606 564 A1 | 7/1994 |
| EP | 2 786 675 A2 | 10/2014 |
| WO | 2012/149588 A1 | 11/2012 |

OTHER PUBLICATIONS

German Search Report (Application No. 20 2015 105 679.6) dated Sep. 6, 2016.

* cited by examiner

SETTING DEVICE FOR A LATCHING ARRANGEMENT FOR SETTING A MOVABLE FURNITURE PART WHICH IS RECEIVED ON A FURNITURE BODY

This application claims the benefit under 35 USC §119 (a)-(d) of German Application No. 20 2015 105 679.6 filed Oct. 26, 2015, the entirety of which is incorporated herein by reference.

FIELD OF THE INVENTION

The present invention relates to a setting device for a latching arrangement for setting a movable furniture part which is received on a furniture body, and to a latching arrangement having a setting device of this type, and to a furniture item having a latching arrangement of this type.

BACKGROUND OF THE INVENTION

A setting device for a latching arrangement of the type which is denoted in the introduction are known, for example, as an eccentric piece for an adjusting adapter for adjusting the inclination of a drawer. In the case of known inclination adjustment device, for example, the setting device is configured on a base plate which is arranged on a rear-side region of a drawer. Here, the setting device serves to position a sliding piece in a latching manner, by way of which sliding piece the spacing of the drawer from a guide and therefore the inclination of a drawer front can be adjusted.

SUMMARY OF THE INVENTION

The present invention is based on the object of providing an alternative setting device for a latching arrangement for setting a movable furniture part which is received on a furniture body.

The present invention proceeds from a setting device for a latching arrangement for setting a movable furniture part which is received on a furniture body, the setting device comprising a receptacle, a spring member and an operating lever, the setting device being mounted on a holding member of the latching arrangement such that it can be pivoted via the receptacle, and a latching element being configured on the spring member.

The latching arrangement advantageously comprises a holding member and an adjusting element. The latching arrangement can be mounted with the holding member on the movable furniture part and can be coupled via a coupler of the adjusting element to a guide device of the furniture body.

The furniture part is advantageously guided movably on the furniture body by means of the guide device. The guide device comprises, for example, a body rail and a movement rail which is provided for attachment to the movable furniture part and which is mounted such that it can be displaced with respect to the body rail, the body rail being attached fixedly to the furniture body.

In one advantageous variant of the present invention, the latching arrangement is mounted with the holding member on a rear side of the movable furniture part, for example, a drawer, and couples to the movement rail via a coupler of the adjusting element in a rear region of the movement rail and/or of the movable furniture part.

In the mounted state on the latching arrangement, the setting device is advantageously connected rotatably to the holding member via the receptacle, for example, by way of a rivet or a pin. In the mounted state, the setting device rotates, for example, parallel to a movement plane of the adjusting element.

The adjusting element is advantageously mounted on the holding member of the latching arrangement, for example, such that it can be displaced linearly. In the mounted state of the setting device on the latching arrangement, the adjusting element is arranged on the holding member such that it can be displaced, for example, between the holding member and the setting device, in particular, in one movement plane.

For example, the adjusting element comprises a latching groove or latching depression which matches the latching element, in particular, a latching lug of the latching element, and with which the latching element of the spring member latches. As a result, an adjusting position of the latching arrangement, for example, of the adjusting element on the movable furniture part can be fixed and/or varied for setting the inclination of the drawer front.

The essential aspect of the present invention is then to be seen in the fact that the shape of the spring member, and therefore the position of the latching element, can be varied by means of the operating lever, without interaction with a further element.

The position of the latching element can advantageously be varied by means of the operating lever in the opposite direction to a latching direction of the latching element.

By way of the advantageous configuration of the operating lever, it is possible for a user to grip the setting device, for example, with one hand, for example, with two fingers of one hand, and to position and/or to set the setting device and/or the adjusting element of the latching arrangement by way of comparatively simple operation, for example, pressing together of the operating lever. Moreover, it can be possible for a user to operate the setting device and/or the operating lever without looking at them/it.

In one preferred variant of the present invention, the position of the spring member can be varied by means of the operating lever in a perpendicular direction with respect to a pivoting plane of the setting device.

The setting device is advantageously configured from a plastic, metal and/or a combination of the materials.

Moreover, it is advantageous that the setting device comprises two operating levers, and the operating levers are arranged on the receptacle symmetrically, so as to lie opposite one another.

As a result of a symmetrical arrangement of the operating levers, the setting device can be gripped comparatively simply by a user using one hand.

In particular, the setting device comprises precisely two operating levers, and the two operating levers are arranged on the receptacle so as to lie opposite one another, for example, parallel to one another and/or such that they project in one plane.

The spring member can be configured on the receptacle next to the operating lever or between the operating levers, for example, next to one another in one plane. Moreover, it is advantageous that the spring member and the operating lever are configured on the receptacle such that they project in the same direction.

In one advantageous modification of the present invention, the spring member and the operating lever are configured on the receptacle in such a way that, in a mounted position on the furniture part, they are connected to one another exclusively via the receptacle.

As a result, the operating lever and the spring member can move in opposite directions, for example, in movement directions which are directed perpendicularly with respect to one another.

It also proves advantageous that the operating lever is configured as a spring element.

As a result of the configuration as a spring element, the operating lever can be deformed elastically. Moreover, the operating lever permits, for example, elastic bending in only one plane.

It is also advantageous that the operating lever is configured as a leg of a leg spring.

The setting device advantageously comprises a second operating lever which is configured as a further leg of the leg spring.

As a result of the configuration of the setting device as a leg spring, in particular of the operating levers as legs of the leg spring, the operating levers return into their starting position after operation by way of the user has been ended.

In one advantageous variant of the present invention, the operating lever has a spring action direction which lies perpendicularly with respect to a spring action direction of the spring member and/or a latching direction of the latching element of the spring member.

Moreover, it is advantageous that the spring member is a leaf spring.

As a result of this measure, the spring member can push into a latching position with the adjusting element on the latching arrangement in the mounted state of the setting device.

It is proposed, furthermore, that the operating lever comprises an operating member.

An operating lever advantageously comprises an, in particular, wedge-shaped operating member which is configured on the operating lever on the side which faces the spring member.

With the aid of the operating member, it is possible for a user to press or to push the operating lever below the spring member and, as a result, to release the spring member from its latching position.

It is shown in a further refinement of the present invention that the operating member engages behind the spring member, with the result that the latching element of the spring member can be raised out in the opposite direction to the latching direction of the latching element. As a result, in the mounted state of the latching arrangement with the setting device, the latching action of the latching element of the spring member to the latching groove of the adjusting element is advantageously released, and a setting position of the setting device and of the adjusting element can be varied.

Moreover, it is advantageous that the operating lever has a gripping element.

The gripping element is advantageously configured in such a way that a user can grip and/or operate the operating lever on the gripping element using one finger in a comparatively reliable, firm and/or comfortable manner.

For example, the gripping element has a structure, for example, a grooved structure, on its surface, as a result of which an increased adhesion effect is achieved, on account of increased friction between the finger of the user and the surface of the gripping element.

In one advantageous variant of the present invention, the setting device, in particular, the spring member, the operating lever and the receptacle are configured together, in one piece or integrally.

This has the advantage that the setting device can be produced inexpensively as one unit, for example, in a plastic injection molding process.

BRIEF DESCRIPTION OF THE DRAWINGS

Exemplary embodiments will be described in greater detail, specifying further details and advantages, using the diagrammatic drawings below, in which.

DETAILED DESCRIPTION OF THE INVENTION

Figure 1:
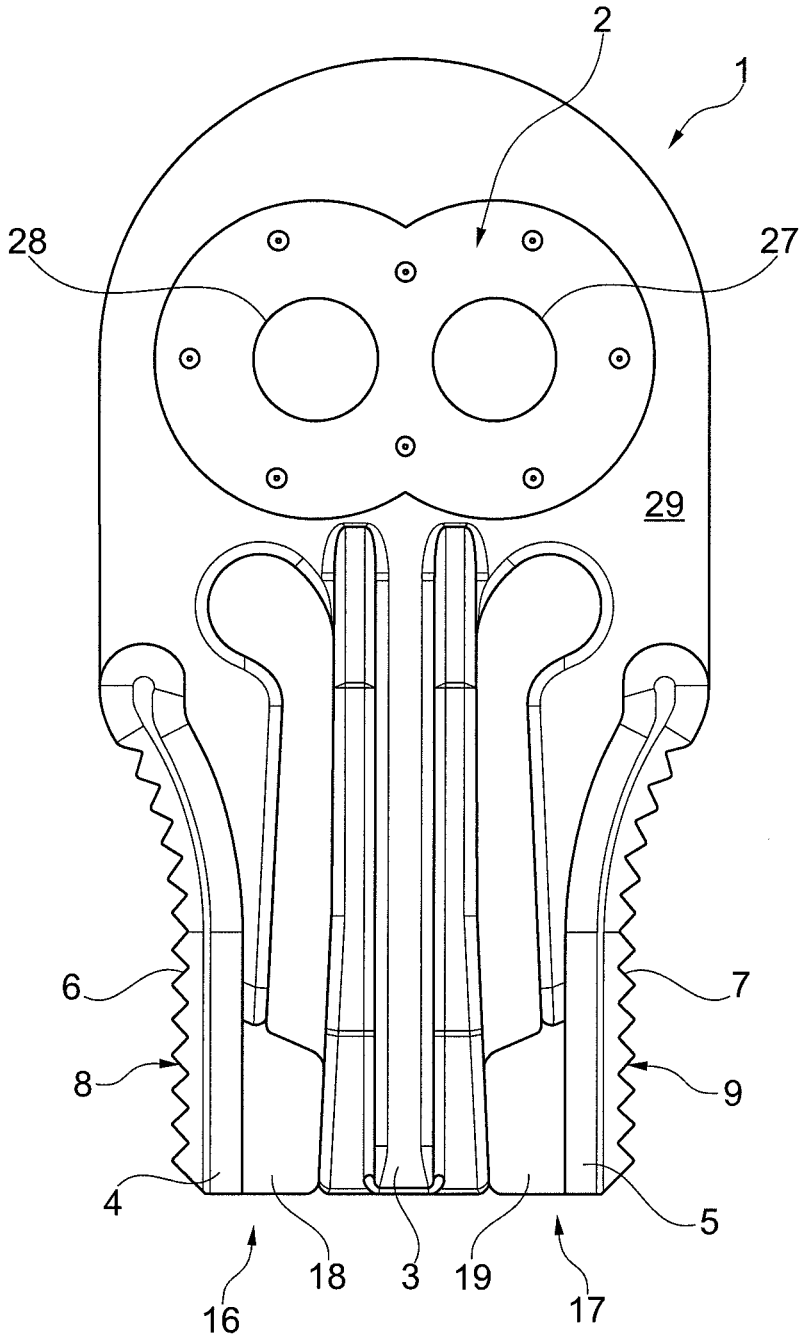
FIG. 1 shows a plan view of a setting device according to the present invention.
Figure 2:
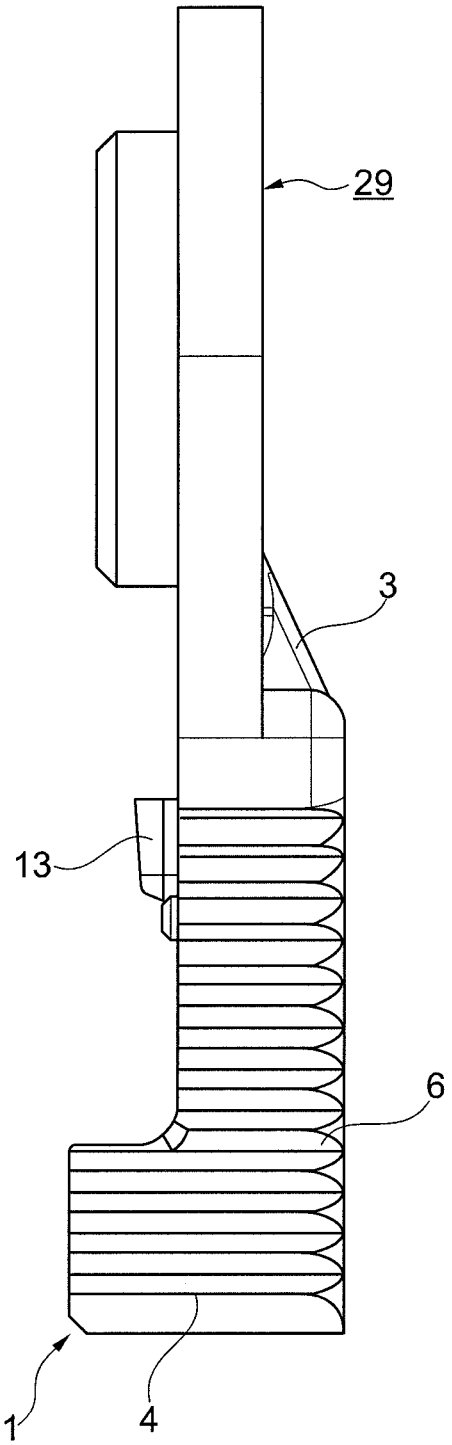
FIG. 2 shows a side view of the setting device from FIG. 1.
Figure 3:
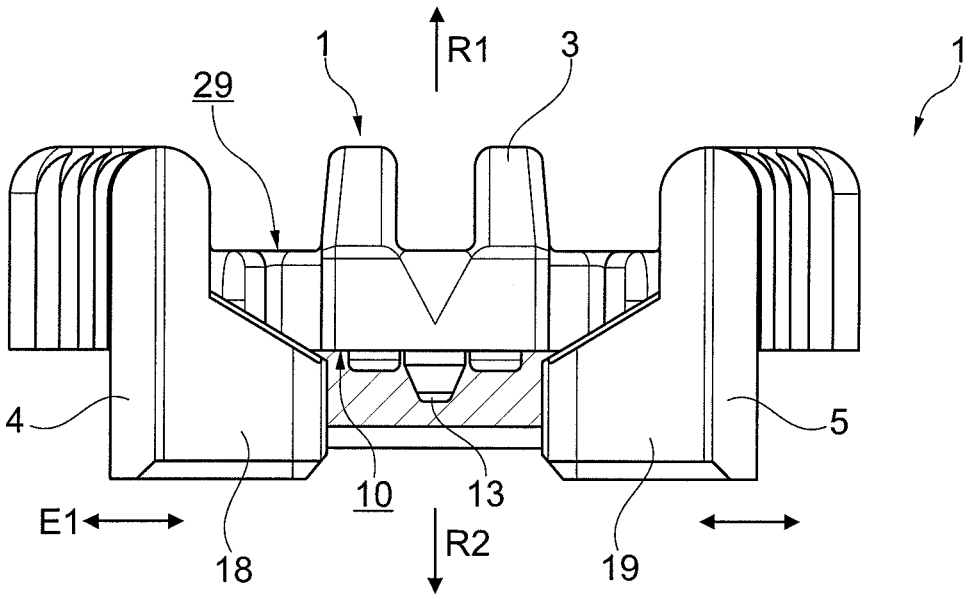
FIG. 3 shows a further side view of the setting device from FIG. 1.

A setting device 1 comprises a receptacle 2, a spring member 3 and two operating levers 4, 5 (FIGS. 1 to 3).

The receptacle 2 of the setting device 1 is configured as a flat, disk-shaped member, on which the spring member 3 and the operating levers 4, 5 are arranged so as to project in a direction parallel to one another. The receptacle 2 comprises two holes 27, 28, via which the receptacle 2 is attached rotatably on a holding member 12 by means of a pin 26. To this end, the pin 26 is configured so as to be widened in a disk-like manner at its upper end, and the widened disk is embedded into a corresponding recess on an upper side 29 of the receptacle 2 in such a way that the upper side 29 terminates approximately flush with the outer pin disk. By way of the disk-like widened portion of the pin 26, the receptacle 2 is fixed rotatably on the holding member 12, in a parallel direction to the rotational axis on the pin 26.

The operating levers 4, 5 are formed, for example, as elongate or rod-shaped, flat, sprung elements, and have gripping elements 6, 7 on their narrow outer side face. To this end, the narrow, outer side face of the operating lever 4, 5 is advantageously curved or bent inward in a circular manner, and a structure 8, 9 which is, in particular, grooved is configured on the surface of the gripping element 6, 7 or the side face.

Operating members 18, 19 which are, for example, wedge-shaped are configured at an outer end 16, 17 of the operating lever 4, 5 so as to lie opposite one another on the operating lever 4, 5. The operating levers 4, 5 are configured on the holding member 12 in such a way that they can be deflected in a sprung manner in a plane E1 parallel to a surface 30 of the holding member 12.

The spring member 3 is likewise configured as an elongate or rod-shaped, flat, sprung element, and comprises a latching lug 13 on a broad, elongate side face 10 which faces the holding member 12 of the latching arrangement in the mounted state on the latching arrangement 11. The latching lug 13 is configured so as to project from the surface of the side face 10, and is shaped in a matching manner with respect to a depression 14 of an adjusting element 15.

The spring member 3 is arranged on the receptacle 2 in such a way that it can be deflected in a sprung manner in a direction R1 perpendicularly with respect to the surface 30 of the holding member 12 and perpendicularly with respect to a spring direction of the operating levers 4, 5.

Figure 4:
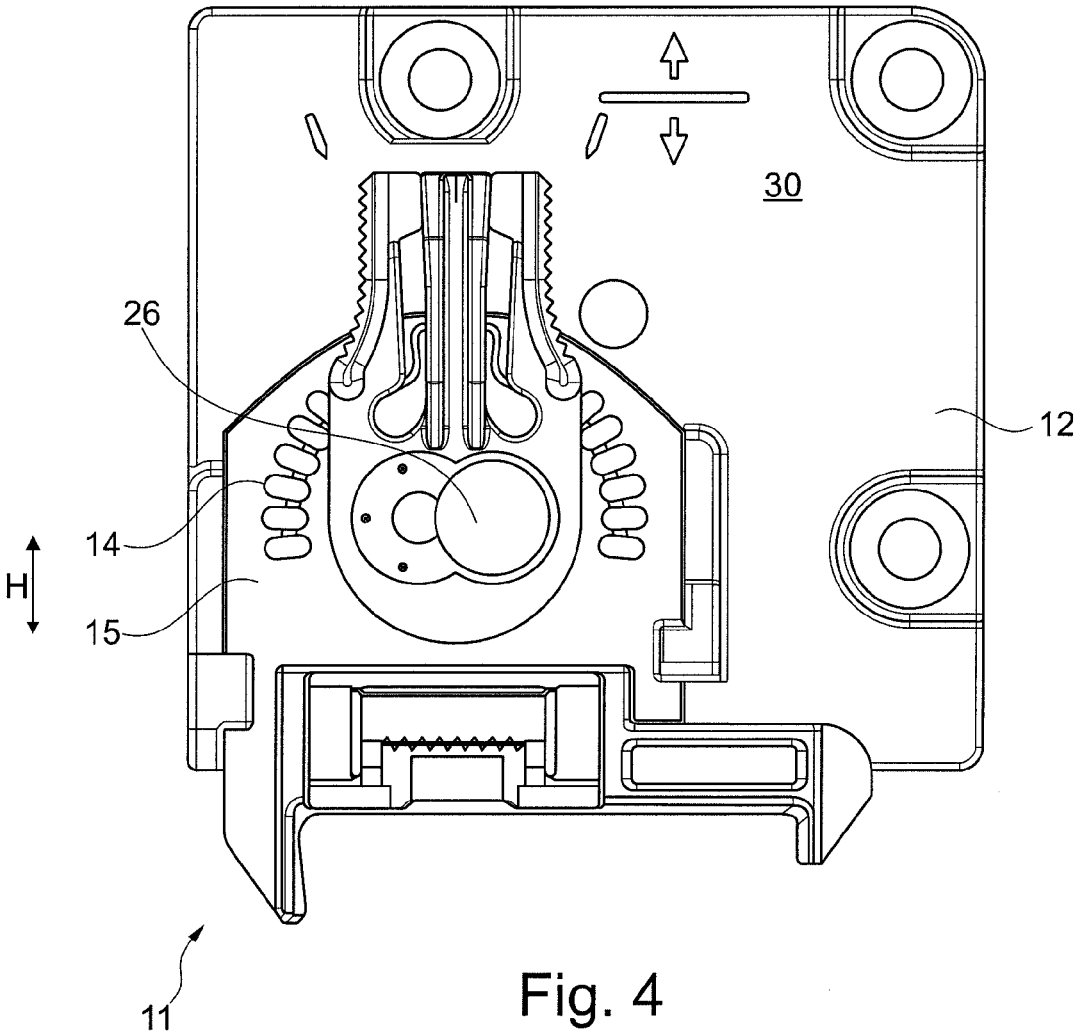
FIG. 4 shows a plan view of a latching arrangement having a setting device according to FIG. 1.

In the mounted state of a latching arrangement 11 which comprises the setting device 1, the holding member 12 and the adjusting element 15, the adjusting element 15 is arranged such that it can be displaced between the holding member 12 and the setting device 1 (FIG. 4).

The setting of the adjusting element 15 on the latching arrangement 11 by way of a user can proceed as follows:

In a first step, a user grips the two operating levers 4, 5 at the gripping elements 6, 7, for example, using one hand, and presses or bends both operating levers 4, 5 out of their starting position on the receptacle 2 toward one another. As a result, the wedge-shaped operating members 18, 19 are pushed or pressed below the spring member 3. The spring member 3 yields with a sprung movement perpendicularly with respect to the bending movement of the operating levers 4, 5 and perpendicularly with respect to the surface 30 of the holding member 12 away from the surface 30 of the operating members 18, 19. The latching lug 13 of the spring member 3 is released as a result of the yielding movement out of its fixed or latched position, out of the depression 14 of the adjusting element 15. As a result, fixing of the adjusting element 15 is released.

It is also conceivable that, in a first step, a user actuates exclusively a single operating lever 4, 5, in order to achieve an adjustment of the spring member 3. Furthermore, it is correspondingly conceivable that the setting device comprises a single operating lever 4, 5 for adjusting the spring member 3 in a further variant.

In a next step, with the operating levers 4, 5 still being held or pressed together, the user can then vary a position H of the adjusting element 15 relative to the holding member 12.

In a further step, the user releases the operating levers 4, 5, and the latter move back as a result into their starting position relative to the receptacle 2, on account of their configuration as a spring element. As a result, the tensioned spring member 3 likewise pushes back into its starting position in the direction of the surface 30 (R2).

Figure 5:
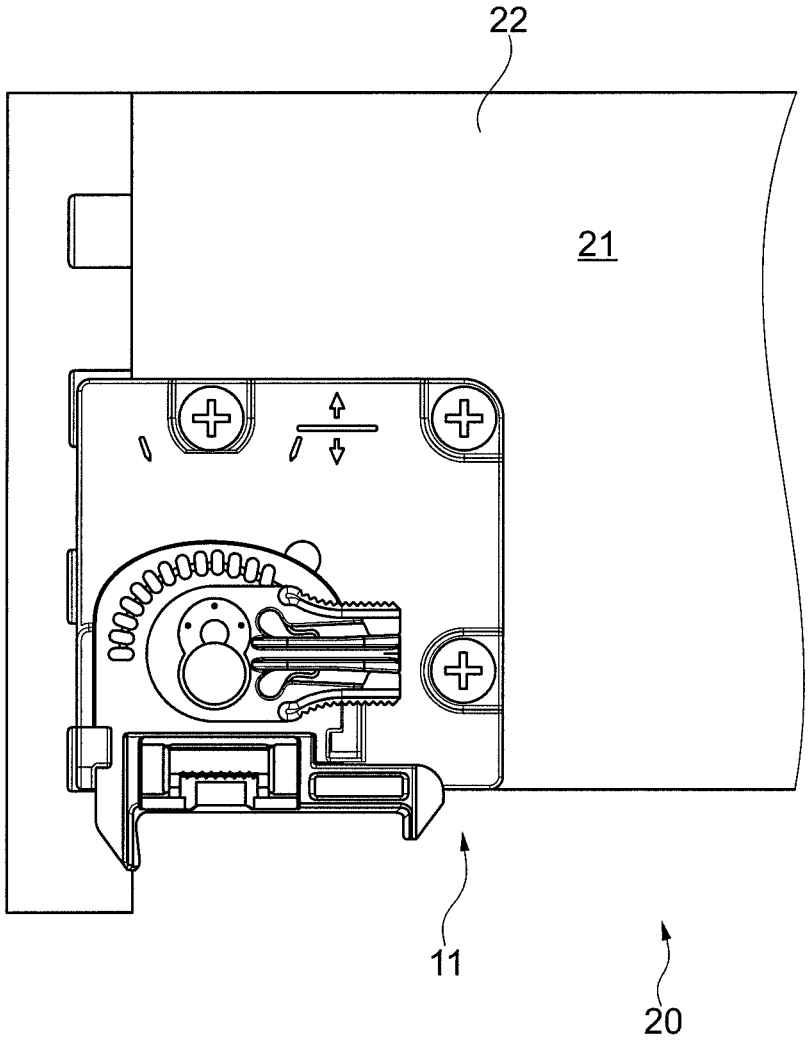
FIG. 5 shows a plan view of a drawer rear side having a latching arrangement according to FIG. 4 mounted thereon.

Finally, the user rotates the setting device 1 about the rotational axis of the pin 26 until the latching lug 13 latches into a depression 14 of the adjusting element 15. The latching arrangement 11 is therefore fixed and set in a new adjusting position (FIG. 5).

Figure 6:
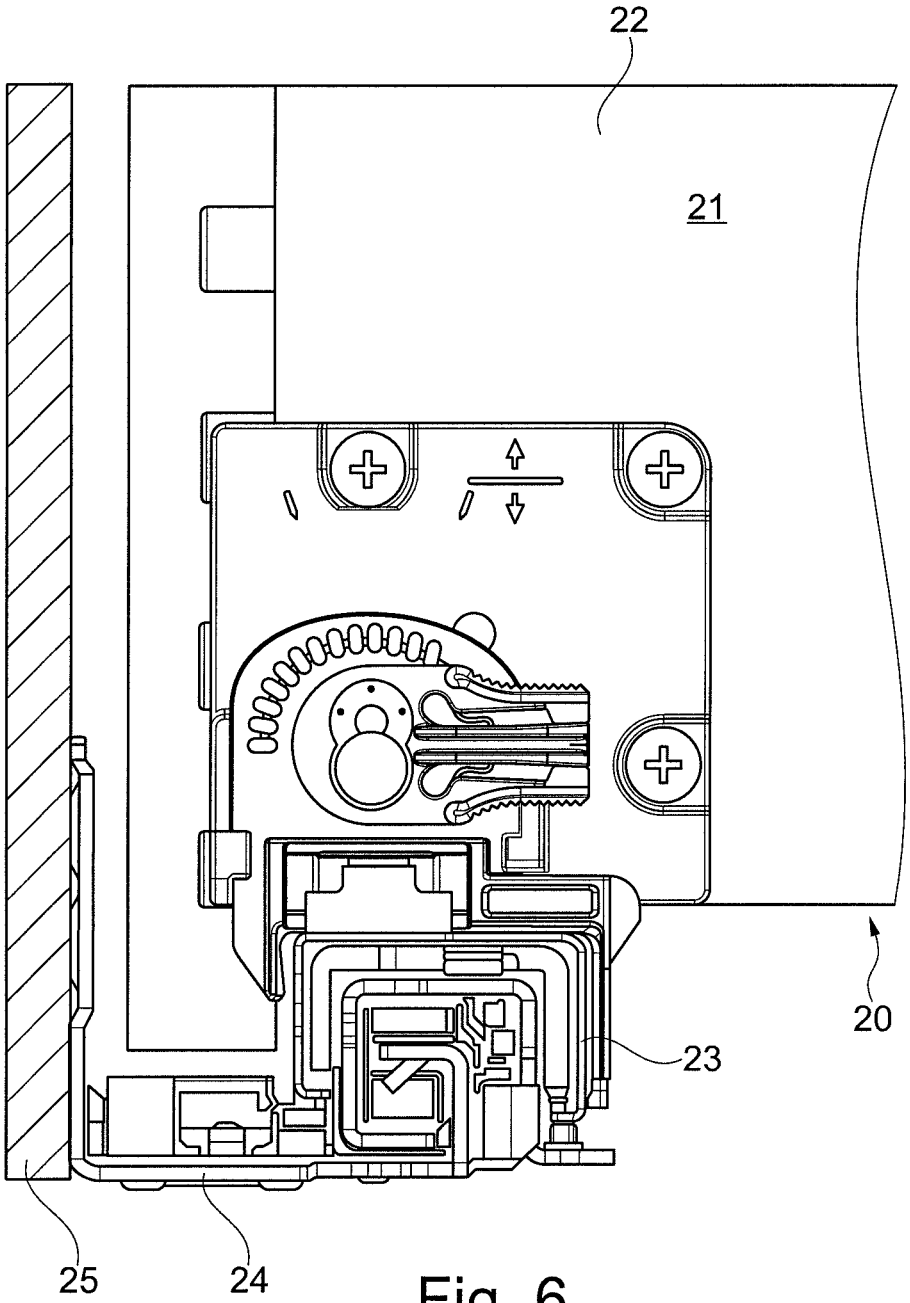
FIG. 6 shows a drawer with the latching arrangement according to FIG. 5 mounted thereon, which latching arrangement is mounted on a furniture body such that it can be moved on guide rails.

In the mounted state, the latching arrangement 11 on the drawer 20 is screwed to an outer side face 21 of the rear wall 22. Here, the latching arrangement is arranged on the rear wall 22 in such a way that it can interact with a guide rail 23 which is mounted on the furniture body 25 such that it can be moved with respect to a body rail 24 (FIGS. 5, 6).

LIST OF REFERENCE NUMERALS

1 Setting device
2 Receptacle
3 Spring member
4 Operating lever
5 Operating lever
6 Gripping element
7 Gripping element
8 Structure
9 Structure
10 Side face
11 Latching arrangement
12 Holding member
13 Latching lug
14 Depression
15 Adjusting element
16 End
17 End
18 Operating member
19 Operating member
20 Drawer
21 Side face
22 Rear wall
23 Guide rail
24 Body rail
25 Furniture body
26 Pin
27 Hole
28 Hole
29 Upper side
30 Surface

The invention claimed is:

1. A setting device for a latching arrangement for setting a movable furniture part which is received on a furniture body, the setting device comprising a receptacle, a spring member and an operating lever, the spring member having a shape of a sprung element, the operating lever being configured as a spring element, and the setting device being adapted to be mounted on a holding member of the latching arrangement such that it can be pivoted via the receptacle, said setting device further comprising a latching element configured on the spring member, wherein a position of the sprung element shape of the spring member, and therefore a position of the latching element, can be varied only by movement of the operating lever, wherein the operating lever comprises an operating member configured in such a way, so as to engage behind the spring member, that the latching element of the spring member can be moved in the opposite direction to the latching direction of the latching element.

2. The setting device according to claim 1, wherein the setting device comprises two operating levers, and the operating levers are arranged on the receptacle symmetrically, so as to lie opposite one another.

3. The setting device according to claim 1, wherein the spring member and the operating lever are configured on the receptacle in such a way that they are connected to one another exclusively via the receptacle in an installed position on the furniture part.

4. The setting device according to claim 1, wherein the operating lever is configured as a leg of a leg spring.

5. The setting device according to claim 1, wherein the operating lever has a spring action direction which lies perpendicularly with respect to a spring action direction of the spring member and a latching direction of the latching element of the spring member.

6. The setting device according to claim 1, wherein the spring member is a leaf spring.

7. The setting device according to claim 1, wherein the operating lever has a gripping element.

8. The setting device according to claim 1, wherein the spring member, the operating lever and the receptacle are configured together integrally in one piece.

9. A latching arrangement having a setting device according to claim 1, the latching arrangement comprising a holding member and an adjusting element, wherein the latching arrangement is adapted to be mounted with the holding member on the movable furniture part and coupled via a coupler of the adjusting element to a guide device of the furniture body.

10. A furniture item having a latching arrangement according to claim 9.

* * * * *